US005664466A

United States Patent [19]

Miller

[11] Patent Number: 5,664,466

[45] Date of Patent: Sep. 9, 1997

[54] APPLIANCE FOR OPENING SCREW-TOP JARS

[76] Inventor: Jame Leslie Miller, R.R. 1, Elmwood, Ontario, Canada, N0G 1S0

[21] Appl. No.: 497,415

[22] Filed: Jun. 30, 1995

[30] Foreign Application Priority Data

Jul. 7, 1984 [GB] United Kingdom ..... 9413667

[51] Int. Cl.[6] ..... B67B 7/00

[52] U.S. Cl. ..... 81/3.25; 81/3.4

[58] Field of Search ..... 81/3.25, 3.4

[56] References Cited

U.S. PATENT DOCUMENTS 2,810,311 10/1957 Smith ..... 81/3.4
4,085,632 4/1978 Hogan et al. ..... 81/3.25

*Primary Examiner*—James G. Smith
*Attorney, Agent, or Firm*—Anthony Asquith & Co.

[57] ABSTRACT

The household appliance is for receiving the cap of a screw-top jar, and for gripping the cap so firmly that a person can bring all available force to bear to crack open the cap. The appliance includes flanges (one of which is toothed) which are bent up from a flat panel. The flanges are rigid and strong, whereby they do not deflect under the gripping forces.

8 Claims, 2 Drawing Sheets

APPLIANCE FOR OPENING SCREW-TOP JARS

This invention relates to a household kitchen appliance for assisting in the task of releasing and unscrewing the cap of a screw-top jar or bottle, which has been screwed on too tightly.

BACKGROUND TO THE INVENTION

The problem of how to remove an over-tightened cap from a screw-top jar, though it happens many, many times, can be very demanding. Most persons, when the task arises, struggle with the jar in one hand and the cap in the other hand, trying to exert a forceful twist. Often, a little moisture on the hands will cause a loss of friction, leading to the frustration that the force one's hands are capable of exerting cannot be brought to bear.

Another problem can be that the person puts so much effort into applying the unscrewing force that he loses control and, when the cap finally cracks open, the sudden loss of resistance can cause the jar to be dropped or spilled.

Often, a householder faced with a tight cap on a food jar will attempt to loosen the cap by striking blows against the cap. The potential dangers of striking the cap are all too clear.

These examples serve to illustrate that there is a need for an appliance which will simplify the task of slackening tight screw-caps, in an economical and efficient manner.

Persons with arthritis and other hand-weakening afflictions have no less a requirement to gain access to the contents of screw-top jars. The appliance is very useful to such person.

The invention arose from considerations of the problem of providing a single component, no-moving-parts low-cost appliance, made from sheet metal and requiring, in its manufacture, only such simple operations as stamping and bending, without machining.

DETAILED DESCRIPTION OF PREFERRED EMBODIMENTS

By way of further explanation of the invention, exemplary embodiments of the invention will now be described with reference to the accompanying drawings, in which.

Figure 1:
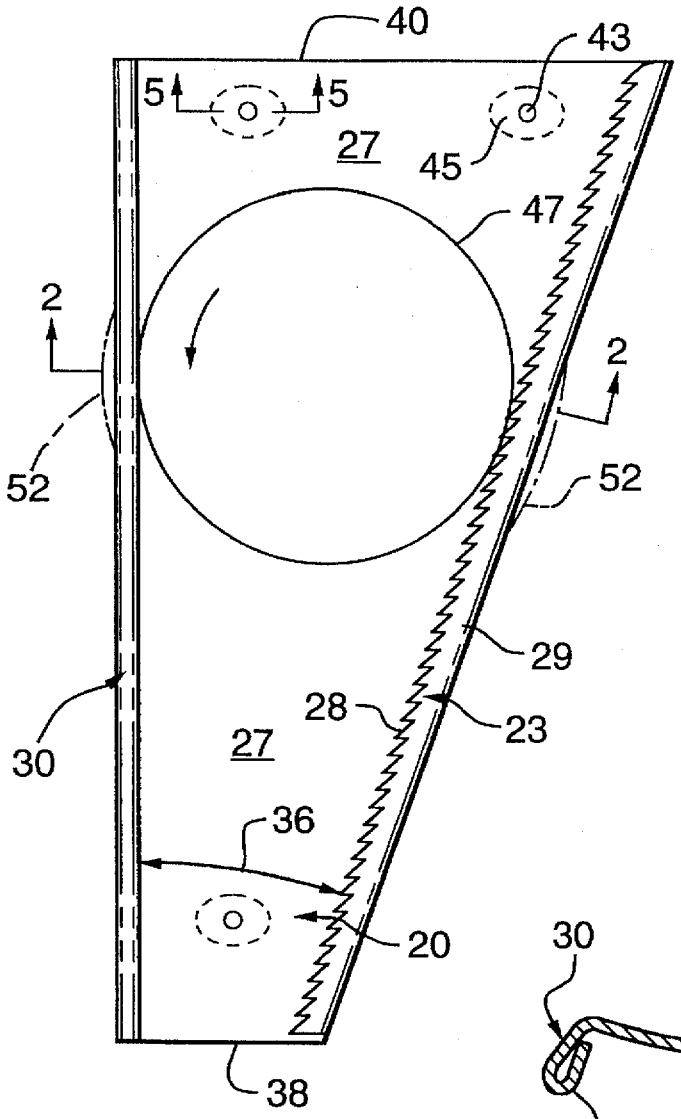
FIG. 1 is a plan view, from below, showing an appliance of sheet metal which embodies the invention in operation.

The appliances shown in the accompanying drawings and described below are examples which embody the invention. It should be noted that the scope of the invention is defined by the accompanying claims, and not necessarily by specific features of exemplary embodiments.

The appliance comprises a piece 20 of folded sheet metal, the metal being steel, preferably stainless steel. At the right side of the appliance (looking from underneath, in the orientation in which the appliance is used in practice) the metal is folded over to form a double flange 23. The double flange 23 comprises a riser 25, which lies at right angles to the main panel 27 of the sheet 20 of metal, and a platform 29, which is folded back to lie at right angles to the riser 25, and parallel to the first plane of the panel 27.

Teeth 28 are cut on the inward-facing exposed thickness-edge of the platform 29. (The teeth 28 are formed by a stamping operation on the sheet metal, which of course is carried out before the metal is folded.)

The riser 25 extends between 0.2 and 0.3 inches out from the plane of the panel 27. The platform has a width, excluding the teeth, of at least 0.1 inches. The teeth may be 0.06 inches deep.

On the left side of the appliance (FIG. 1 and FIG. 2), the sheet metal 20 again is bent at right angles to the plane of the panel 27, this time to form a flange 30. The flange 30 includes a riser 31, the outer marginal region or platform 32 of which is folded inside and then folded back to form a hemmed portion 34. The left flange extends between 0.3 and 0.5 inches out from the plane of the panel. The thickness-edge 35 of the metal of the hemmed portion 34 lies directly facing, and adjacent to the panel 27, as shown.

The double flange 23 on the right side of the appliance, and the hemmed flange 30 on the left side, are arranged so as to create a tapered gap therebetween. The angle 36 included between the flanges 23,30 is about 20 degrees. The angle 36 is important from the standpoint of the functional operation of the appliance in that if the angle is too large the appliance will not function properly. The angle 36 is important also because the angle defines the range of sizes of jar cap that can be accommodated in the appliance.

If the angle 36 is too small, only a small range of cap sizes can be accommodated. The length of the flange 23 with teeth 28 in the appliance should not be longer than about 10 or 11 inches, nor shorter than 8 or 7 inches, because an appliance in that range of sizes is easy to accommodate under a cabinet or shelf. Preferably the toothed length of the flange 23 is about 9 inches.

For practical purposes of folding over the flanged edges 23,30 during manufacture of the appliance, the minimum distance 38 apart of the tips of the teeth 28 from the nearest point on the hemmed flange 30 has to be about one inch. With an angle 36 of about 20 degrees, the corresponding widest distance 40 apart is about 5 inches. (Thus the size of cap that can be placed in the appliance has to be in the range 1 inch to 5 inches in diameter.)

Figure 3:
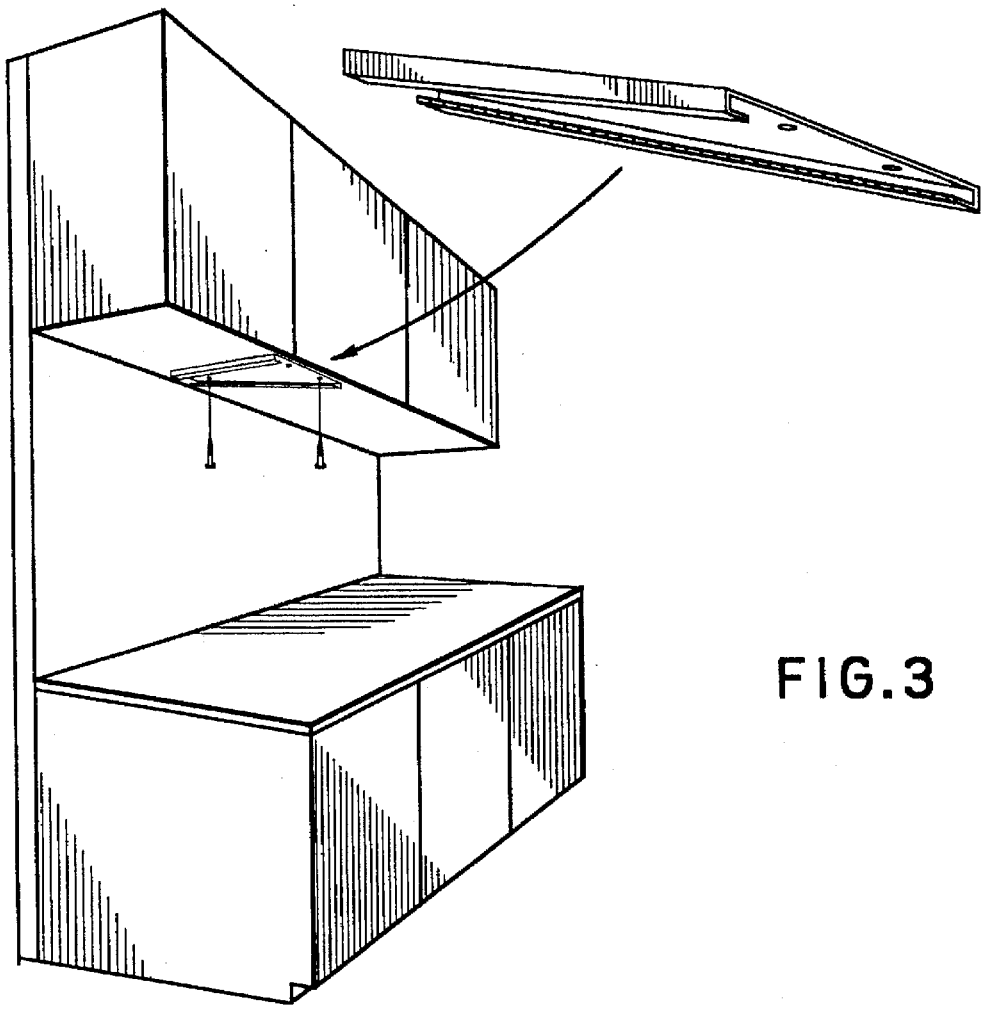
FIG. 3 is a pictorial view of the appliance, attached underneath a kitchen cupboard.
Figure 5:
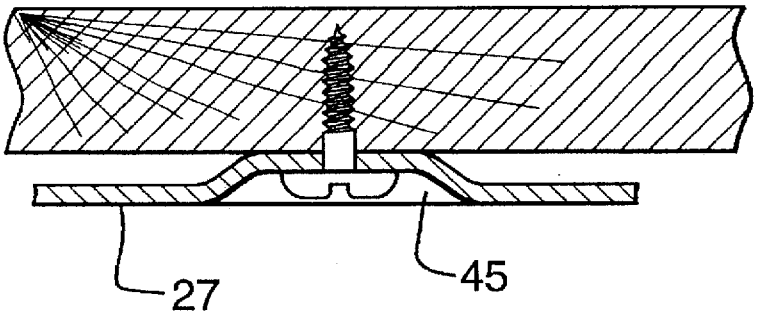
FIG. 5 is a cross-section on line 5—5 of FIG. 1.

The device is installed underneath a kitchen cabinet or shelf, as shown in FIG. 3. Holes 43 in the panel 27 receive fixing screws. The holes 43 are formed within respective recesses 45 (FIG. 5), whereby the heads of the screws do not protrude below the level of the sheet metal in the panel 27.

In use, a person takes the screw-top jar (upon which the cap has been screwed too tightly) and places the jar, right side up, ie with the cap uppermost, into the appliance. The person manipulates the jar so that the top face of the cap lies flat against the undersurface of the panel 27, and in fact the person should exert an upward pressure on the jar to ensure this is so.

The person moves the cap down into the angle 36 between the flanges 23,30, until the cap lies between the flanges, and touches both of the flanges. This is the position of the jar-cap 47 is shown in FIG. 1.

Next, the person, who at this point is grasping the body of the jar in his hand, applies a turning moment to the body of the jar. The cap 47 at first rotates, or tends to rotate, with the jar.

It will be understood from FIG. 1 that such rotation has tendency to cause the right side of the cap 47 to move upwards (by slipping relative to the flange 23), and/or the left side of the cap to move downwards (by slipping relative to the flange 30). However, the teeth 28 engage the cap so vigorously that the right side of the cap really cannot slide or slip upwards relative to the flange 23.

The teeth 28 in fact are preferably set at an angle towards the narrow end of the taper, as shown, to reinforce the resistance to possible slipping of the cap upwards relative to the flange 30.

Therefore, when the jar is turned, and the cap rotates, it is the left side of the cap 47 that moves, not the right side, in that the left side of the cap moves downwards (FIG. 1) relative to the flange 30. As a result, the cap moves deeper into the angle 36, whereby the cap is gripped even more tightly between the flanges. The cap 47 therefore becomes gripped very securely indeed when the cap is turned in the anti-clockwise FIG. 1) direction, and in fact becomes automatically self-gripping when the cap is turned anti-clockwise. This condition depends on the angle of taper 36, which should be set by the designer so that the condition is obtained. (Of course, if the cap were turned clockwise, there would be no tendency for the appliance to exert any sort of grip at all on the cap.)

If the cap is screwed on very tightly, the person has to apply more and more force to rotate the jar. However, because the position of the jar and cap are so firmly established and under control, because of the layout of the appliance, the person can easily apply this force, up to the limit of his strength. In other appliances, the person would put so much of his hand-power into just gripping the jar and the cap that only a little force could be brought to bear to the task of turning the cap.

The more tightly the cap is screwed onto the jar, then, as the jar is turned, the more deeply the cap is driven into the angle between the flanges, and the more firmly the teeth bite into the cap. Finally, of course, the idea is that the tightness of the cap is overcome, and the cap is released.

The appliance does not increase the turning force—the whole of the force comes from the persons' hands on the jar. What the appliance does is to grip the cap, and hold the cap against turning anti-clockwise, no matter how hard the jar is turned.

The tighter the cap, and the more the jar is turned, the greater becomes the grip on the cap, until the cap-to-jar tightness is broken. The gripping force is directed radially inwards towards the centre of the cap. The reaction to this increasing gripping force is directed radially outwards, and is supported by the two flanges 23,30. Therefore, the flanges should be so constructed that the flanges do not deflect (ie move apart) to any significant extent, when reacting the gripping force. To whatever extent the flanges are flimsy enough that they can be deflected apart by the reaction to the gripping force, to that extent there is a limitation on the magnitude of the gripping force that can be developed in the appliance.

Figure 4:
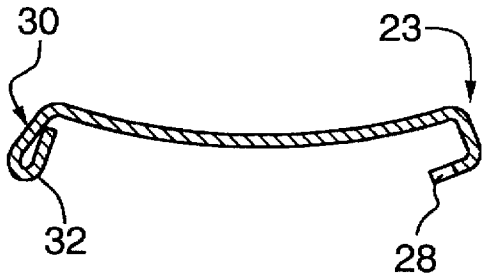
FIG. 4 is a diagram corresponding to FIG. 2, illustrating a manner of bending the sheet metal.

FIG. 4 shows the mode of deflection in question.

Given that the flanges, being made of real materials, can never be absolutely rigid, the requirement is that the flanges be designed to be rigid enough that the flanges can support enough of a gripping force on the cap, without the flanges deflecting apart, that no matter how tightly the cap is screwed on, sufficient force can be applied to release it. In fact, the practical limit should be that whatever force a person can apply with his hands, the flanges are stiff enough not to deflect apart under the gripping force that results from that turning force.

It is recognised that the factors which reduce or limit the maximum gripping force that can be achieved in the appliance should not arise from an inherent deflectability of the flanges, but should arise rather from such factors as the structural strength of the cap/jar, or the hand-strength of the person. That is to say, the appliance should be so strong and rigid that the appliance is stronger than the cap and jar, and is stronger than a person's hand strength. The appliance should be designed so as to stand up to any force that can be placed upon it, or at least any force that can arise during the course of reasonable use.

At the same time, the appliance must be economical. Obviously, if cost were of no consequence, it would be easy to design a sophisticated jar/cap opening appliance of immense strength and rigidity. But cost is important, and for the appliance as described herein to find wide acceptability, it is necessary that the appliance be designed so as to be of the required high level of strength and rigidity, and yet at the same time to be at the required low level of cost.

Therefore, the designer must see to it that the sheet metal is used in an effective and efficient way. The appliance should be designed to receive the forces acting on the metal, and to distribute the forces into the metal, in such a way that the main bulk of the metal is not just "idle" but is contributing towards supporting the stresses.

On cost grounds, the metal sheet from which the appliance is made should be as thin as possible. Consequently, the designer, in seeking to avoid the use of thicker metal, should see to it that the metal is disposed in a way that will make the best use of the bulk of the metal.

Also from the costs standpoint, it is very much preferred that the appliance should consist of just a single piece of sheet metal. The designer should avoid anything by way of for example, separate fixed-on jaws and grippers (and certainly should avoid anything that could be classed as a moving part). When the appliance is a single piece of sheet metal, the handling of the product, during manufacture, from initial stamping to placing the product in its final packaging, is kept to a minimum.

The manner in which the flange deflect is quite complex, as may be understood from the drawings. FIG. 4 indicates a mode in which the flanges 23,30 bend apart. In this mode, clearly, the panel 27 is playing a considerable role in resisting the deflection. If the panel 27 however, had a hole (ie a large hole, not a small hole such as the fixing holes 43) in it, it will be understood that the magnitude of the bending deflection could be expected to increase substantially.

Therefore, if the main panel 27 is to contribute to the rigidity of the appliance, and hence if the panel is to be as thin as possible, the panel should be free of holes. If the panel had holes, it would have to be formed of a thicker metal.

It should be noted that the panel may not be made thin on the grounds that the cabinet or shelf will contribute to the rigidity and strength of the panel, and hence to the appliance. It might be considered that it would be possible for the designer to gain access to the inherent stiffness of the cabinet, by fixing the panel securely to the cabinet.

However, the designer should not seek to have the panel fixed so securely to the cabinet that the cabinet can contribute its own strength and stiffness to the appliance: to do that, all the stresses would have to be transmitted between the panel and the cabinet through the fixing screws, which, being screwed into wood (and cabinets are often made of chip-board or the like) often cannot support high stresses and would soon work loose. The fixing screws serve to hold the appliance steady against the turning forces applied to the jar by the person: the fixing screws must not be allowed to "feel" the gripping forces (or rather the reaction to the gripping forces, which tends to force the flanges apart).

The presence of the fixing holes 43, so long as they are small, has no effect on the inherent stiffness of the panel 27. It makes no difference to the ability of the panel to resist the kind of deflection shown in FIG. 4 whether the small fixing holes are there or not.

The reaction to the gripping force, in addition to causing the panel to bend in the manner as indicated in FIG. 4, also causes the flanges to bend, or to tend to bend, in the manner as indicated at 52 in FIG. 1. This type of bending maybe resisted by making the flange thick. While one way of making the flange thick would be to use thick sheet metal, a better way is to arrange the bends in the metal so that the metal is located where it will contribute to the resistance to bending.

Figure 2:
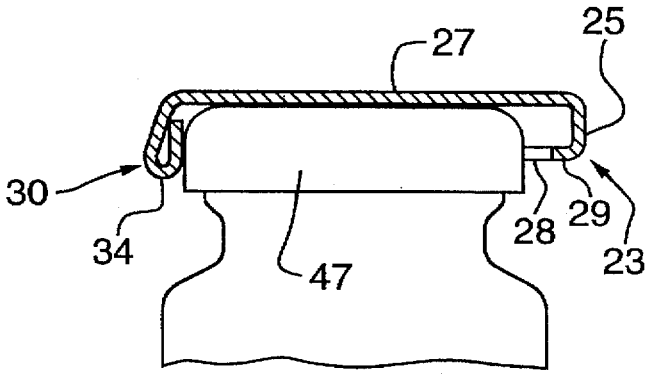
FIG. 2 is a cross-section on line 2—2 of FIG. 1.

As shown in FIG. 2, the flanges both have been given thickness by virtue of the shape into which the flanges have been bent. The toothed flange 23 especially has been given stiffness in this mode, by virtue of the presence of the wide platform 29. The wider the platform 29, the stiffer the right flange 23. The flange 23 being stiff, the stresses can be fed into the length of the flange, and therefore to some extent relieved or reduced at the actual point of contact. The metal even from some distance along the length of the flange 23 can contribute to resisting the type of bending as shown at 52, in FIG. 1.

The left side flange also has been given width by virtue of the hemmed-over edge. The edge is not quite so wide as the platform 29; however, the left side flange 30 is less prone to deflection of the type shown at 52 than the right side, because at the right side the gripping force is fed into the flange 23 at discrete points, ie the tips of the teeth. Therefore, whilst more width to the left side flange would of course make that flange stiffer, in fact the flange is stiff enough, as compared with the right side flange, when formed with the hemmed edge as shown.

Also, from the standpoint of providing width to the left side flange 30, it would be awkward, when considering supporting and holding the sheet metal during the operation of bending over the two flanges, for both of them to have wide platforms. It is recognised that it is better for the right flange to have a wide platform than for the left flange to have a wide platform.

In respect of the right flange, the sheet metal is presented edge-on to the cap, ie the teeth are cut in the edge of the material. In respect of the left flange, the sheet metal is presented flat-on to the cap. In fact, in the left side flange, in contrast to the right side flange, the metal preferably should not be presented edge-on. If it were, the relatively sharp thickness-edge might dig into the soft material of the cap, and such digging in might then interfere with the smooth sliding of cap down the left side flange and into the angle. On the right side flange, the teeth are intended to dig into the cap, but the cap should be free to move easily over the surface of the left side flange. Therefore, the hemmed edge of the left side flange is preferred to, say, so bending the left flange as to be a mirror-image of the right.

The sheet metal 20 from which the appliance is made should be at least 0.025 inches thick, and preferably between 0.30 to 0.40 inches thick. The metal is too thin, in the context of the invention, if the flanges can bend to such an extent as to limit the maximum gripping force that can be developed to a magnitude that is less than is available from the hand-strength of a normal person, and is less than the force needed to crack the tightness of the screw-cap.

As mentioned, the metal should be thick enough also to be rigid enough not to transfer any heavy operational stresses into the fixing screws, since the screws would then work loose. Fixing screws can easily take the forces associated with resisting the turning force on the jar; but the gripping force is a much higher force, and the gripping force should be internally reacted within the metal of the flanges and panel.

It is a requirement that the cap should not slip relative to the right side flange, but should slip relative to the left side flange. Other means for creating a good cap-to-flange grip on the right side may be contemplated, such as placing a rough-surface material on the flange. However, then the appliance would consist of two components, which is an immediate large increase in cost.

The appliance may be used with bottles, jars, containers, and the like, which are made of glass, plastic, metal, or the like. The cap may be of plastic, soft metal, plastic-coated metal, or the like.

The appliance as described is simple to make, and simple to package. The appliance is also advantageous as regards being easy to present for sale, in that it is obvious what the appliance is, and what it is used for. The level of technology involved in the appliance "looks" appropriate for the task it performs. The appliance has no moving parts, nothing to assemble, and requires no installation other than simple fixing screws. The appliance is universal, requires no adjustment, and is operable in a manner that holds no surprises, and demands little by way of skill and attention from the use.

Simple though the appliance is from these standpoints, in fact the design, to achieve that simplicity, is, as has been described, quite sophisticated.

I claim:

1. An appliance for simplifying the task of unscrewing a tightly-screwed-on cap from a jar, wherein:

the appliance comprises a body of sheet metal;

the body of sheet metal is bent over to form a left flange along a left edge, and is bent over to form a right flange along a right edge, the body of sheet metal forming a predominantly flat panel between the bent-over flanges;

the flanges are so arranged as to define therebetween a taper, which is suitable for receiving the screw-cap;

the flat panel between the flanges is free of perforations, being perforations of a size that, if present, would effect the stiffness, in bending, of the panel;

the right flange includes a riser, the riser being bent up from the plane of the panel, and includes a platform, the platform being bent inwards from the riser whereby (a thickness-edge of the metal) forming the right flange faces towards the left flange;

(the said thickness-edge of the right flange) is formed with teeth, which are effective, when in forceful contact with the screw-cap, to substantially prevent sliding or slipping of the screw-cap along the right flange;

the left flange is bent up from (a plane of the panel) and includes a folded portion so arranged as to increase the overall thickness of the left flange beyond the thickness of the sheet;

in respect of the folded portion, the metal of the left flange is folded to form a riser depending from the flat panel, the riser being so folded with respect to the flat panel that, after folding the riser extends away from the flat panel;

the metal of the left flange is folded to form a platform depending from the riser, the platform being so folded with respect to the riser that, after folding the platform extends inwards towards the right flange, and lies parallel to the flat panel;

the metal of the left flange is folded to form a hemmed portion depending from the platform, the hemmed portion being so folded with respect to the platform that, after folding, the hemmed portion extends inwards and back towards the flat panel, whereby, after folding, the hemmed portion lies inside the riser and doubled under with respect to the riser;

the left flange is arranged with a smooth surface, which is arranged for contact with the screw-cap, and along which, when in contact with the screw-cap, the screw cap can slide and slip;

the thickness of the sheet metal is sufficient that the appliance is stiff and strong enough to react and contain, between the flanges, a gripping force of sufficient magnitude to hold the cap against the forceful turning of the jar, being a turning force of the maximum magnitude that can be exerted by a person holding and turning the jar.

2. Appliance of claim 1, wherein, in respect of the right flange,the riser lies at right angles to, and the platform lies parallel to, the plane of the panel.

3. Appliance of claim 1, wherein the riser extend between about 0.2 and 0.3 inches up from the plane of the panel.

4. Appliance of claim 1, wherein the platform has a width excluding the teeth, of at least 0.1 inches.

5. Appliance of claim 1, wherein in respect of the left flange, the metal is so folded that the thickness-edge of the metal is substantially concealed, and faces directly towards the panel.

6. Appliance of claim 5, wherein the said smooth surface of the left flange is a surface of the hemmed portion that so disposed as to lie flat-on to a screw-cap lying between the flanges.

7. Appliance of claim 5, wherein the flange extends between 0.3 and 0.5 inches up from the level of the plane of the panel.

8. Appliance of claim 1, wherein the panel is perforated with holes of a small size, which is suitable for receiving fixing screws, and the panel is formed with a recess in respect of each hole, whereby the heads of the fixing screws lie in the recesses, and thereby do not protrude from the plane of the panel in the direction towards the flanges.

* * * * *